United States Patent [19]

Guhlin

[11] Patent Number: 5,051,104

[45] Date of Patent: Sep. 24, 1991

[54] FLUSHING DEVICE FOR MOTORBOAT ENGINES

[76] Inventor: Kjall G. Guhlin, 11727 Sheridan, Houston, Tex. 77050

[21] Appl. No.: 511,192

[22] Filed: Apr. 19, 1990

[51] Int. Cl.[5] ..... B08B 9/00

[52] U.S. Cl. ..... 440/88; 440/900; 134/167 R

[58] Field of Search ..... 440/88, 89, 113, 900; 134/94, 99, 166 R, 167 R, 168 R, 169 A, 171, 172, 199

[56] References Cited

U.S. PATENT DOCUMENTS

| | | | |
|---|---|---|---|
| 3,002,488 | 10/1961 | Guhlin | 440/113 |
| 3,931,828 | 7/1076 | Lawler | 440/900 |
| 4,121,948 | 10/1978 | Guhlin | 440/88 |
| 4,359,063 | 11/1982 | Carlson | 440/900 |
| 4,589,851 | 5/1986 | Karls | 440/900 |

*Primary Examiner*—Sherman Basinger
*Assistant Examiner*—Stephen P. Avila
*Attorney, Agent, or Firm*—Vaden, Eickenroht, Thompson & Boulware

[57] ABSTRACT

An apparatus is disclosed for use in flushing the cooling systems of water cooled outboard and inboard/outboard motorboat engines that draw cooling water through intakes in the engine housing beneath the surface of the water in which the boat is operating. The apparatus allows lubricant to be injected into the cooling system after the cooling system has been flushed with clean, fresh water to leave a coating of oil in the surfaces of the cooling system to prevent rust from forming on the surface. The apparatus consists of a U-shaped or bighted spring with two legs on which are slidably mounted two cup-shaped seal members constructed of elastomeric material. The seal members are positioned over the cooling intakes of the engine housing. One of the seal members has an opening through which clean fresh water is introduced and the other sealing member has an opening through which lubricant is injected.

6 Claims, 1 Drawing Sheet

FLUSHING DEVICE FOR MOTORBOAT ENGINES

This invention relates to apparatus for use in flushing the cooling systems of outboard and inboard/outboard motorboat engines. The invention, more particularly, is an improved apparatus for introducing lubricants from a conventional aerosol or oil can into the water used to flush the cooling system in a clean, efficient, and convenient manner.

Most motorboat outboard and inboard/outboard engines are cooled by drawing water through intakes in the engine housing that are located beneath the surface of the water in which the boat is operating. It is important to flush the engine's cooling system and water pump with fresh water after use, particularly if the engine has been used in salt water. It is also desirable to add oil to the flushing water to coat the surfaces of the cooling system and water pump with a light film of oil for protection from rust and corrosion.

Two approaches found in the prior art are represented by U.S. Pat. No. 3,002,448 issued to Kjall G. Guhlin et al. and U.S. Pat. No. 4,121,948 issued to Kjall G. Guhlin. The '448 patent disoloses an apparatus for connecting a water hose to the fluid intake at the bottom of the cavitation plate of an engine but without any means for introducing lubricant into the water. The '948 patent does disclose a means for introducing a lubricant into the flushing water. The apparatus for doing this, however, is bulky and difficult to use. The apparatus includes a separate container into which the lubricant must be poured before the flushing operation begins. The open end of the container is attached to a control head having two valves that control the flow of the water through the control head. One is an on-off valve and the second controls the flow of water into the lubricant container. There are two openings in the top of the container located on opposite sides of an orifice. When the second valve is open, according to FIG. 6 of the drawing, water flows through one opening down into the container where it mixes with the lubricant and then flows upwardly out of the container through the second opening and into the cooling system of the engine. This may happen, but it is unlikely. After the container fills with water, the remaining water will more than likely flow out of the downstream opening without traveling very far into the container. Therefore, it is difficult to predict how much lubricant is actually being picked up by the water.

It is an object of the invention to provide apparatus for flushing the cooling system of a motorboat engine that allows a lubricant to be injected into the water directly just before the water enters the intake ports of the engine.

It is a further object of this invention to provide apparatus for introducing lubricant directly into the cooling system of a motor boat engine that is simple to operate and requires no complicated or expensive components.

It is a further object of the invention to provide such a flushing system in which the lubricant can be injected into the water directly from a conventional oil can that can be pumped by hand or a can containing both lubricant and a propellant for ejecting the propellant as an aerosol.

It is a further object of this invention to provide such apparatus that includes a U-shaped spring, a cup-shaped seal member of elastomeric material mounted on each leg of the U-shaped spring for covering the water intakes of the engine, one seal member having an opening through which water under pressure is supplied to the intake and the other seal member having an inlet through which lubricant can be injected into the water to be drawn into the cooling system of the engine.

Other objects, advantages, and features of this invention will be apparent to a person skilled in the art from a consideration of this specification including the appended claim and attached drawing.

Figure 1:
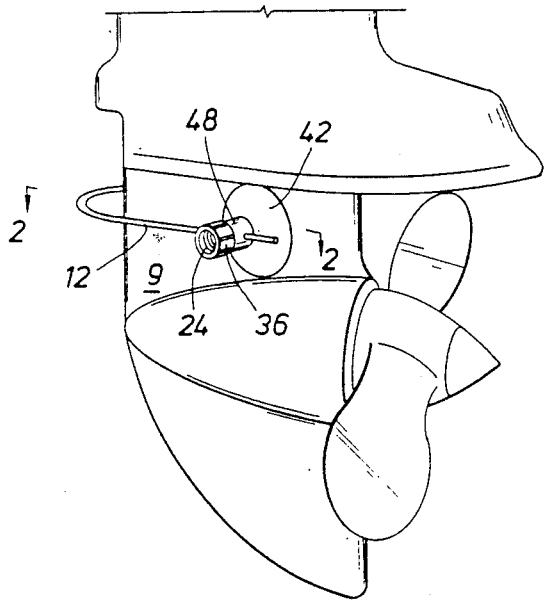
FIG. 1 is an isometric view of the apparatus of this invention positioned on the housing of an outboard engine covering the water intake ports.

In FIG. 1, the preferred embodiment of the apparatus of this invention is mounted on gear housing 9 of a typical motorboat engine. The apparatus includes U-shaped or bighted spring 10 having legs 12 and 14. Cup shaped seal members 16 and 18 of elastomeric material are mounted on the legs by inserting the legs through holes 28 and 30, respectively, in cylindrical portions 48 and 50 of seal members 16 and 18. The diameter of holes 28 and 30 is less than the diameter of legs 12 and 14 so the elastic material of the seal member is stretched and forms a seal around the legs. The cups can slide along the legs and rotate relative to the legs to allow the cups to be positioned quickly and easily to cover the water intake ports of different engines.

The seal members have curved walls 42 and 44, respectively, that flare outwardly from cylindrical portions 48 and 50. When the apparatus is not in use, spring 10 holds seal members 16 and 18 close together so that when the legs of the spring are spread apart to mount the apparatus on the engine, as shown in FIG. 1, the spring will hold the seal members in sealing engagement with the housing.

Figure 3:
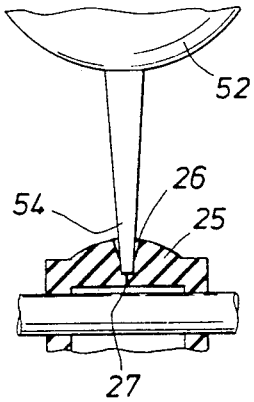
FIG. 3 illustrates the introduction of lubricant into the water through one of the seal members.
Figure 2:
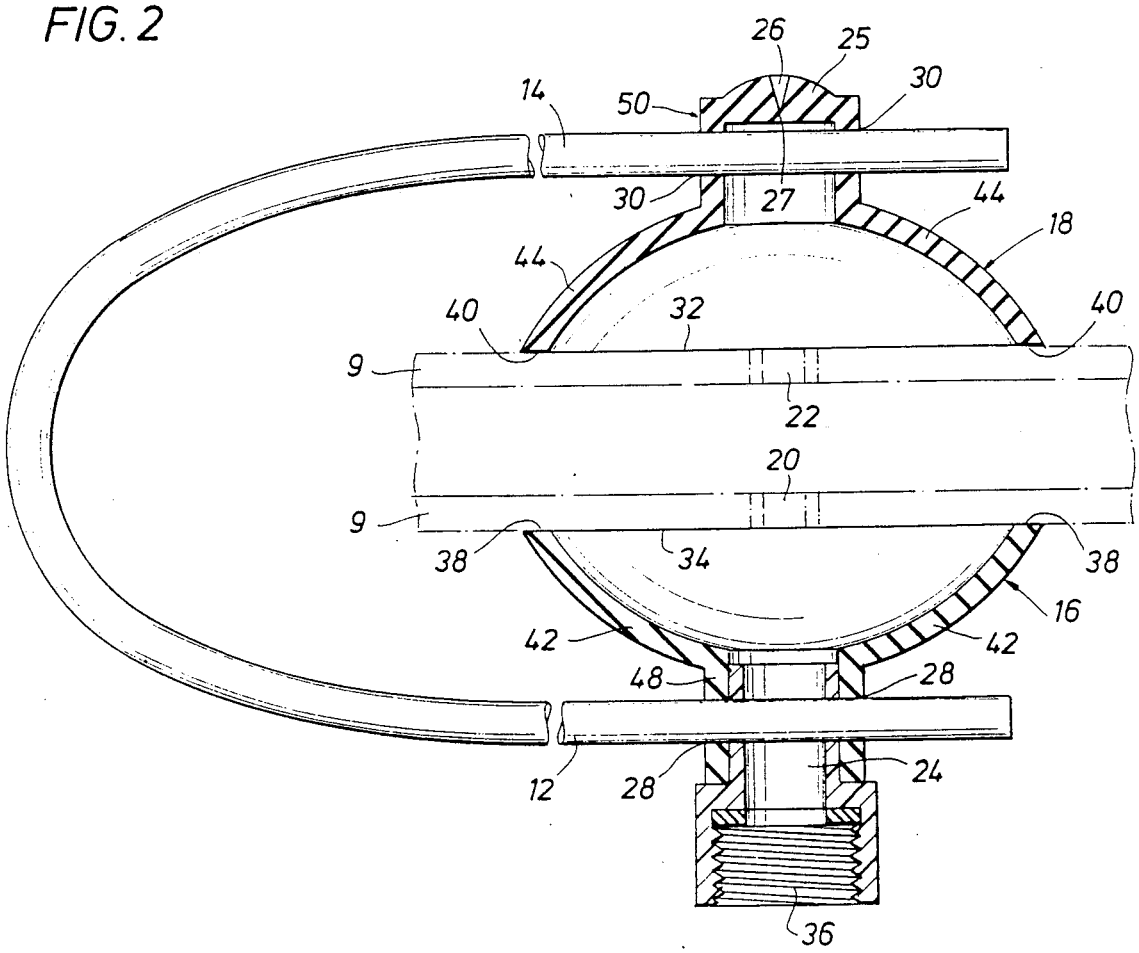
FIG. 2 is a sectional view taken along line 2—2 of FIG. 1.

Cylindrical portion 28 of cup 16 has opening 24 in which is located female hose connection 36. Water is supplied to the inside of the seal members through a water hose (not shown) connected to the hose connection. In accordance with this invention, the other cup shaped seal member has an inlet through which lubricant can be injected into the water inside the cup. In the embodiment shown, the inlet is located in end wall 25 of cylindrical portion 50. It includes tapered wall section 26 converging at opening 27. The opening, which is formed by piercing the portion of wall 25 below the tapered wall section with an ice pick or cutting through with a thin knife blade, is shown closed in FIG. 3 because after the hole or opening is formed it will close when the ice pick or knife is removed because of the memory of the elastomeric material.

During the flushing, water is supplied to the inside of cup 16, usually at city water pressure. The engine is started and the water pump begins to circulate water through the cooling system. More water is available then required so both cups communicating through inlet ports 20 and 22 stay full of water.

After the system has been flushed, with fresh water a lubricating oil is injected into the water in cup 18 by pushing spout 54 of an oil can into tapered section 26 of the inlet. The tapered wall portion is stretched by the spout causing the elastomeric material of the seal member to form a seal around the spout. Oil is then injected into cup 18 through opening 27 and the water and oil is circulated through the cooling system long enough to spread the oil, which is suspended in the water as droplets, throughout the system. Usually three to five seconds is sufficient time. When the engine is shut off, the water drains out leaving a coating of oil on the inner walls of the cooling system. Some pockets in the system will trap small amounts of the oil-water moisture, but the heat of the engine will cause some of the water to evaporate and the rest will evaporate with time leaving a thin film of oil on the surface of the pocket.

The apparatus can also be used to introduce anti-freeze into the system. The anti-freeze will mix with the water trapped in the pockets and keep the water from freezing of the weather is cold. From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for introducing fresh clean water and lubricant into the cooling system of a motorboat engine that draws cooling water through intakes in the engine housing located below the surface of the water in which the boat is operating comprising, a U-shaped spring having first and second legs, first and second cup-shaped seal members constructed of elastomeric material, each of which is mounted on one of the legs of the spring to cover the water inlets of the engine, the first seal member having an inlet through which lubricant can be injected into the water before it enters the engine, the second seal member having threaded connector means for connecting to a water hose to provide the fresh clean water to be drawn into the cooling system of the engine.

2. The apparatus of claim 1 in which the inlet in the first seal member has a wall that tapers outwardly.

3. The apparatus of claim in which the inlet includes a tapered wall section extending partly through the seal member and a slit connecting the tapered wall section to the inside of the cup-shaped seal member.

4. Apparatus for introducing fresh clean water and lubricant into the cooling system of a motorboat engine that draws cooling water through intakes in the engine housing located below the surface of the water in which the boat is operating comprising, a U-shaped spring having first and second legs, a pair of cup-shaped seal members constructed of elastomeric material, each of which is mounted on one of the legs of the spring to cover the water inlets of the engine, one of the seal members having inlet means comprising a slit through which lubricant can be injected into the water as it enters the engine and one of the seal members having threaded connector means for connecting to a water hose to provide the fresh clean water to be drawn into the cooling system of the engine through the cooling water intakes when the engine is running.

5. The apparatus of claim 4 in which the inlet means includes a wall that tapers outwardly from the slit.

6. Apparatus for introducing fresh clean water and lubricant into the cooling system of a motorboat engine that draws cooling water through intakes in the engine housing located below the surface of the water in which the boat is operating comprising, a U-shaped spring having first and second legs, first and second cup-shaped seal members constructed of elastomeric material, each of which is mounted on one of the legs of the spring to cover the water inlets of the engine, the first seal member having an inlet through which lubricant can be injected into the water before it enters the engine, said inlet including a tapered wall section extending partly through the seal member and a slit connecting the tapered wall section to the inside of the cup-shaped seal member, the second seal member having threaded connector means for connecting to a water hose to provide the fresh clean water to be drawn into the cooling system of the engine.

* * * * *